US005362253A

United States Patent [19]

Lin et al.

[11] Patent Number: 5,362,253

[45] Date of Patent: Nov. 8, 1994

[54] DISTRIBUTION CABLE MOUNTING DEVICE

[76] Inventors: Kuang-Ts'an Lin; Shih-Tzung Liang, both of No. 360, Sec. 1, Min-Sheng N. Rd., Kuei-Shan Hsiang, Taoyuan County, Taiwan, Prov. of China

[21] Appl. No.: 176,251

[22] Filed: Jan. 3, 1994

[51] Int. Cl.[5] ..... H01R 9/24

[52] U.S. Cl. ..... 439/462; 439/798; 439/805

[58] Field of Search ..... 439/798, 797, 784, 462, 439/805, 807, 723, 724, 721

[56] References Cited

U.S. PATENT DOCUMENTS

| | | | |
|---|---|---|---|
| 1,941,715 | 1/1934 | Pfisterer | 439/784 |
| 2,076,072 | 4/1937 | Douglas | 439/462 |
| 2,295,899 | 9/1942 | Hoppenstand | 439/805 |
| 3,444,505 | 5/1969 | Becker | 439/805 |
| 5,100,348 | 3/1992 | Herman et al. | 439/798 |

FOREIGN PATENT DOCUMENTS

| | | | |
|---|---|---|---|
| 397618 | 7/1924 | Germany | 439/798 |

*Primary Examiner*—Gary F. Paumen

*Attorney, Agent, or Firm*—Morton J. Rosenberg; David I. Klein

[57] ABSTRACT

A distribution cable mounting device includes a junction block mounted inside an electrical box and having a tapered junction hole with an inner thread, a hollow, tapered plug fitted into the tapered junction hole to secure the conductor of a cable, a hollow screw member having a hollow screw rod at one end threaded into the inner thread on the junction hole and stopped against the tapered plug and a hollow, split, tapered cone at an opposite end tightened by a nut to secure the insulator of the cable.

1 Claim, 3 Drawing Sheets

DISTRIBUTION CABLE MOUNTING DEVICE

BACKGROUND OF THE INVENTION

The present invention relates to a distribution cable mounting device for fastening a distribution cable to a junction block of an electrical box.

Conventionally, the method of connecting a distribution cable to a distribution block inside an electrical box is done by inserting the conductor of the cable into a horizontal junction hole on the distribution block and then threading a screw rod into a vertical screw hole on the distribution block to hold down the conductor of the cable inside the junction hole. One disadvantage of this method is that the conductor of the cable may be damaged by the screw rod easily. Another disadvantage of this method is that the cable may be disconnected from the distribution block easily when it is pulled.

SUMMARY OF THE INVENTION

The present invention provides a distribution cable mounting device which eliminates the aforesaid disadvantages.

According to the preferred embodiment of the present invention, the distribution cable mounting device comprises a junction block mounted inside an electrical box and having a tapered junction hole with an inner thread, a hollow, tapered plug fitted into the tapered junction hole to secure the conductor of a cable, a hollow screw member having a hollow screw rod at one end threaded into the inner thread on the junction hole and stopped against the tapered plug and a hollow, split, tapered cone at an opposite end tightened by a nut to secure the insulator of the cable. Because the conductor and insulator of the distribution cable are respectively secured by the tapered plug and the hollow screw member, the distribution cable does not disconnect from the distribution block when it is pulled. Because the tapered plug and the split cone of the hollow screw member are respectively clamped on the conductor and insulator of the distribution cable around the outside, they do not damage the distribution cable.

DETAILED DESCRIPTION OF THE PREFERRED EMBODIMENT

Figure 1:
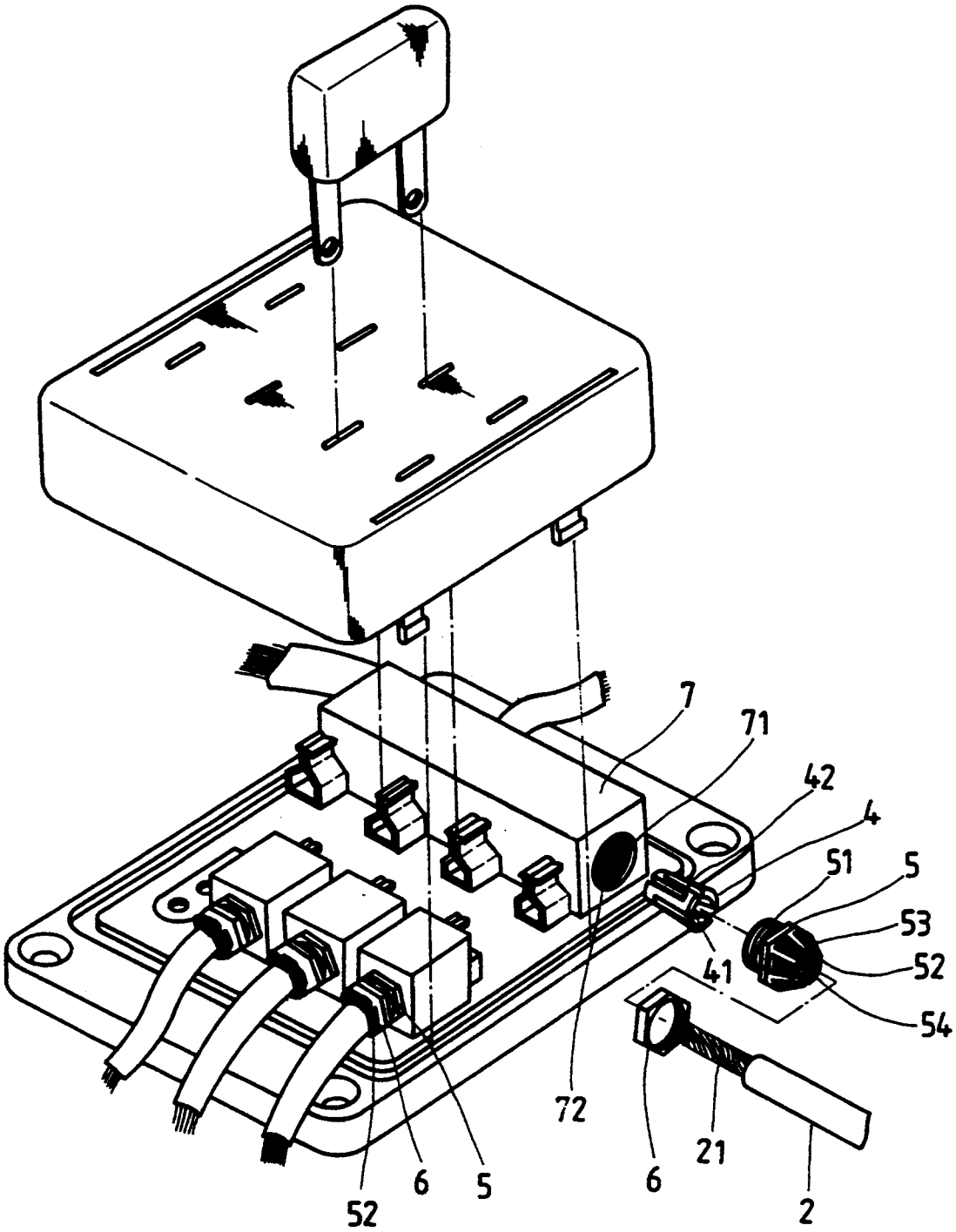
FIG. 1 is an exploded view of a distribution cable mounting device according to the preferred embodiment of the present invention.
Figure 4:
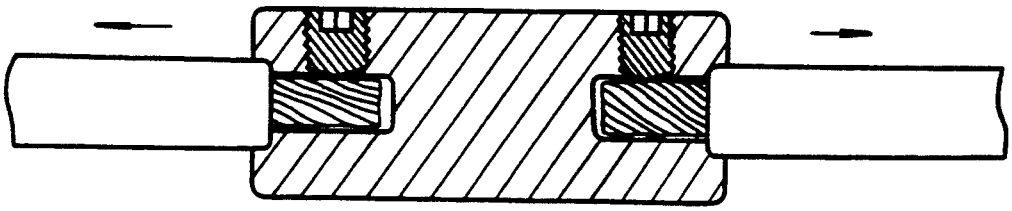
PRIOR ART FIG.4
FIG. 4 is a sectional view showing the distribution cable mounting device of FIG. 3 installed.
Figure 2:
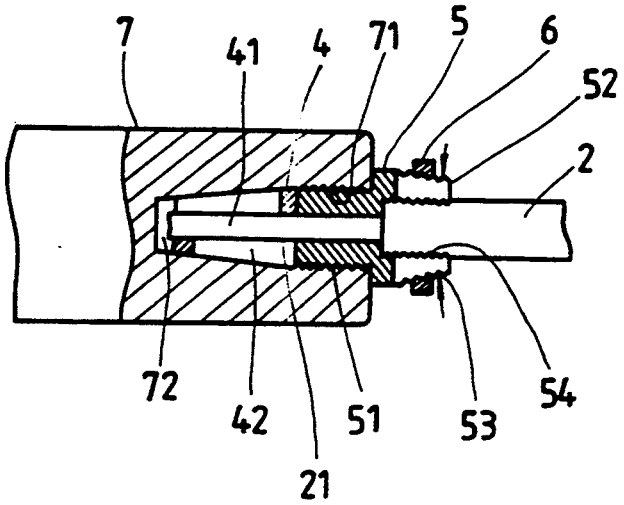
FIG. 2 is a sectional view showing the distribution cable mounting device of FIG. 1 installed.
Figure 3:
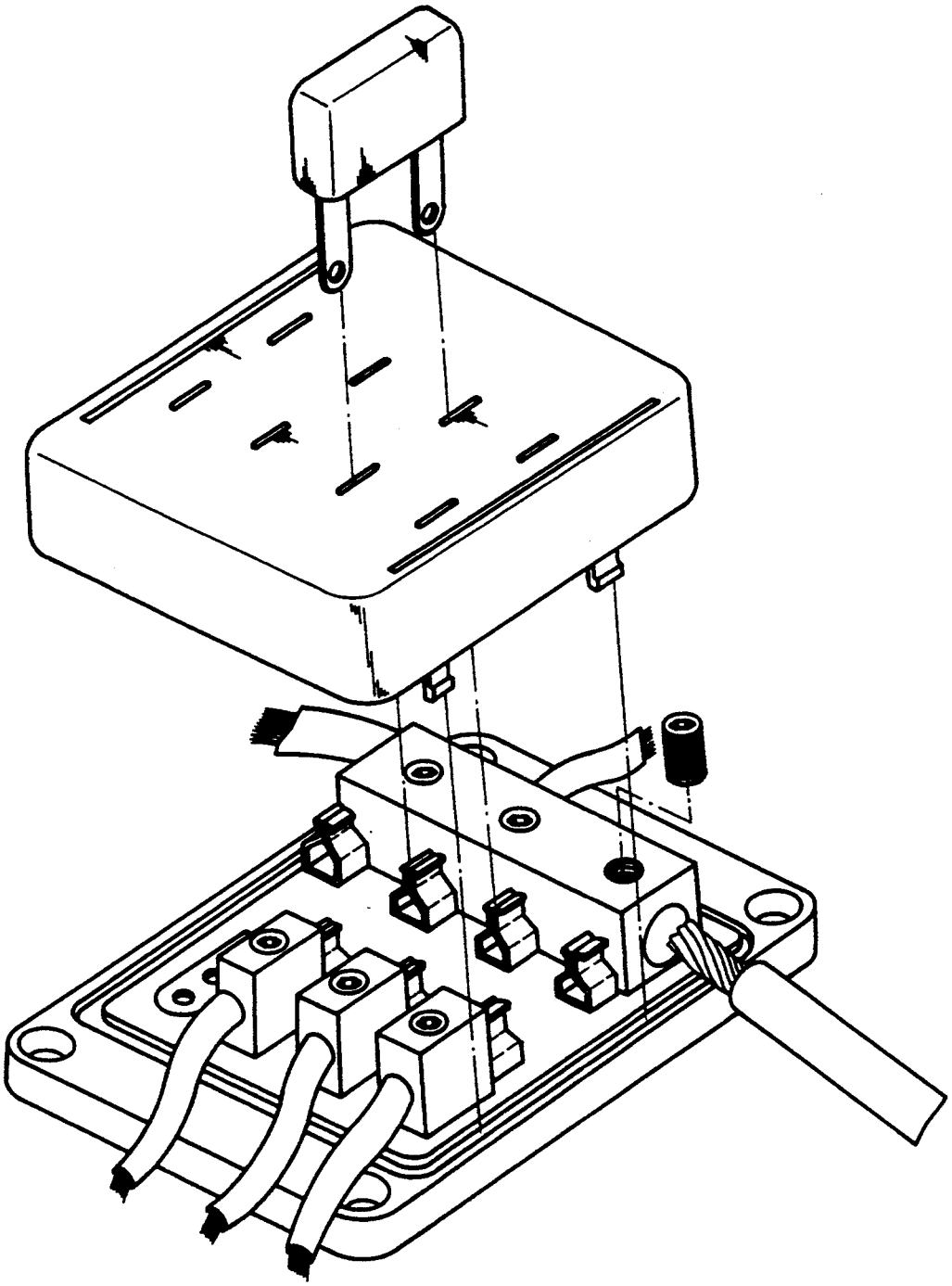
PRIOR ART FIG.3
FIG. 3 is an exploded view of a distribution cable mounting device according to the prior art.

Referring to FIGS. 1 and 2, the junction block, referenced by 7, of an electrical box has a tapered junction hole 72 made gradually smaller toward the inside, and an inner thread 71 on the orifice of the junction hole 72. The conductor 21 of the cable 2 is inserted through a nut 6, a hollow screw member 5, and a hollow, tapered plug 4, and then firmly retained in the tapered junction hole 72 by the nut 6 and the hollow screw member 5 and the tapered plug 4. The hollow screw member 5 comprises a hollow screw rod 51 at one end threaded into the inner thread 71 on the junction hole 72, and a hollow, split cone 52 at an opposite end mounted around the insulator of the cable 2. The split cone 52 has an outer thread 53 over the outside wall thereof, and raised serrations 54 around the inside wall thereof. The hollow, tapered plug 4 has a longitudinal through hole 41 through its length, which receives the conductor 21 of the cable 2 , and a plurality of equally spaced, longitudinal splits 42 respectively extending from either end thereof.

Referring to FIG. 2 again, after the conductor 21 of the cable 2 has been inserted through the nut 6, the hollow screw member 5, and the tapered plug 4, and into the tapered junction hole 72 of the junction block 7, the tapered plug 4 is inserted into the tapered junction hole 72, then the hollow screw rod 51 of the hollow screw member 5 is threaded into the inner thread 71 on the tapered junction hole 72 causing the tapered plug 4 to move inwards and clamp on the conductor 21 of the cable 2, and then the nut 6 is threaded onto the outer thread 53 of the split cone 52 causing the raised serrations 54 of the split cone 52 to engage into the outside surface of the insulator of the cable 2, and therefore the cable 2 is firmly connected to the junction block 7 to make electric contact therewith.

What is claimed is:

1. A distribution cable mounting device comprising:

a junction block mounted inside an electrical box and having a tapered junction hole made gradually smaller from an orifice thereof toward the inside and an inner thread on said junction hole;

a hollow, tapered plug fitted into said tapered junction hole to secure the conductor of a cable permitting the cable to be electrically connected to said junction block, said tapered plug having a longitudinal through hole through the length thereof, and a plurality of equally spaced, longitudinal slits respectively extending from either end thereof;

a hollow screw member having a hollow screw rod at one end threaded into said inner thread on said junction hole and stopped against said tapered plug, and a hollow, split, tapered cone at an opposite end, said tapered cone of said hollow screw member having an outer thread over an outside wall thereof and a plurality of raised serrations around an inside wall thereof; and a nut threaded onto the outer thread of said tapered cone of said hollow screw member causing said raised serrations of said tapered cone of said hollow screw member to engage into insulation of the cable to secure the cable.

* * * * *